US005911336A

United States Patent [19]

Porta et al.

[11] Patent Number: 5,911,336

[45] Date of Patent: Jun. 15, 1999

[54] VACUUM STABILIZER AND METHOD FOR THE MANUFACTURE THEREOF

[75] Inventors: Paolo Della Porta, Carimate; Paolo Manini, Arluno; Fortunato Belloni, Villastanza Di Parabiago; Bruno Ferrario, Rescaldina, all of Italy

[73] Assignee: Saes Getters S.P.A., Milan, Italy

[21] Appl. No.: 08/656,212

[22] PCT Filed: Dec. 2, 1994

[86] PCT No.: PCT/IT94/00201

§ 371 Date: Jun. 7, 1996

§ 102(e) Date: Jun. 7, 1996

[87] PCT Pub. No.: WO95/16166

PCT Pub. Date: Jun. 15, 1995

[51] Int. Cl.[6] ..... B65D 85/72

[52] U.S. Cl. ..... 220/503; 206/524.4; 206/484; 53/406

[58] Field of Search ..... 220/420, 421, 220/422, 423, 424, 503, 504, 505; 53/406; 206/524.4, 484

[56] References Cited

U.S. PATENT DOCUMENTS 3,114,468 12/1963 Francis et al. ..... 220/420
4,668,551 5/1987 Kawasaki et al. .
5,018,328 5/1991 Cur et al. ..... 220/421
5,091,233 2/1992 Kirby et al. ..... 220/421
5,191,980 3/1993 Boffito et al. .

FOREIGN PATENT DOCUMENTS 2 658 736 A1 8/1991 France .

*Primary Examiner*—Joseph M. Moy
*Attorney, Agent, or Firm*—Panitch Schwarze Jacobs & Nadel, P.C.

[57] ABSTRACT

It is described a vacuum stabilizing device comprising a holder (100) impermeable to gases, in the form of a box open at its upper end, with edges folded and prolonged outwards to form a peripheral "wing" (104); a getter material (110) in the lower part of holder (100) inside a lower volume (II) defined by the bottom of the holder and by a lower septum (120), permeable to gases; a dryer material (130) is an upper volume (I) defined by said septum (120) and by a second upper septum (140) permeable to gases. A film (150) of a material impermeable to gases is hermetically fixed to the external part of wing (104), as to seal the whole device. A few methods for producing the device are also described.

17 Claims, 2 Drawing Sheets

154
150
140
120
104

160
142
140
130(132)
152
150
122
I
II
102
110
120
100
104

Fig. 2
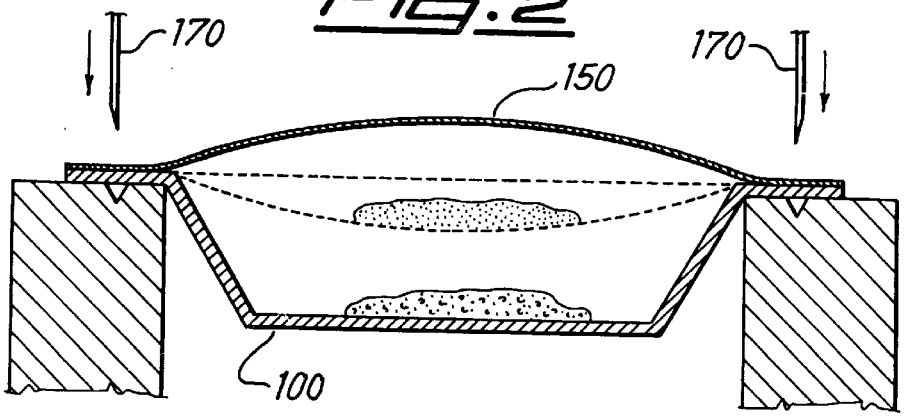
Fig. 3
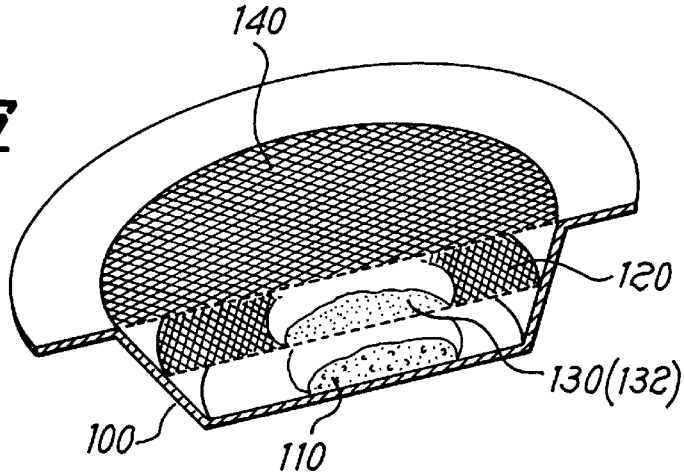
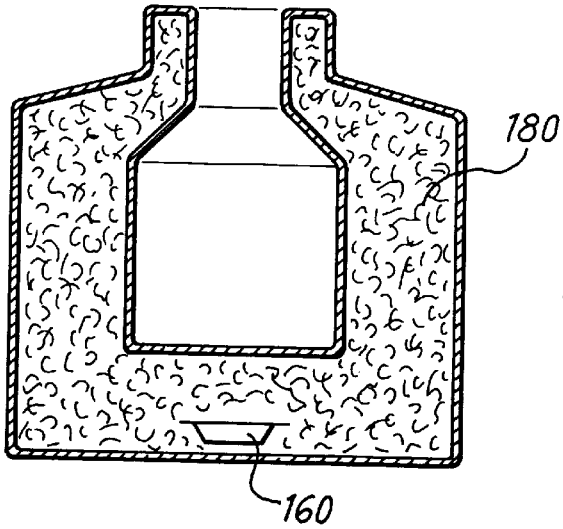
Fig. 4

VACUUM STABILIZER AND METHOD FOR THE MANUFACTURE THEREOF

BACKGROUND OF THE INVENTION

The present invention relates to a vacuum stabilizer and a method for the manufacture thereof.

Such stabilizer can be advantageously exploited for maintaining a satisfactory vacuum degree inside a thermally insulating jacket under vacuum, where also insulating materials of different type may optionally be present.

A vacuum jacket of this kind allows to eliminate or considerably reduce the heat exchange between the environment and an inner chamber, or piping, lying at a temperature different from room temperature, generally lower.

A few typical examples of these end-uses are the Dewar vessels, employed for the storage of cryogenic fluids, as well as the pipings for the transport of same fluids or the insulating panels of refrigerators and freezers; a very and interesting recent case is represented by the tankers containing liquid methane or the liquefied petroleum gases (LPG).

It is known, in the current practice, that a good thermal insulation may be realized by means of a vacuum jacket, which may optionally contain insulating materials like glass wool, colloidal silica, perlite or organic polymers, in the form of foams (for instance open cell rigid polyurethanes or expanded phenolic resins) or in the form of a multilayer, particularly a polyolefinic multilayer mode from polypropylene, polyethylene, olefinic copolymers and so on).

It is known too that the vacuum realized in such a jacket, during its preparation, tends to degrade with the time, because of the degassing of the walls of the jacket, because of a gas infiltration (e.g. CO, $CO_2$, $O_2$, $H_2$, $H_2O$, $N_2$ and so on), because of the possible leaks of the walls or finally, in the case of a wall made from a plastic material, because of a permeation of gases through the walls, particularly the atmospheric gases.

Such a drawback is overcome, in the practice, by introducing one or more materials allowing to fix said gases and the vacuum is normally maintained by resorting to gas sorbing materials, located in the jacket.

These gas sorbing materials can operate according to the physical sorption principle, like for instance in the case of the zeolites and of other molecular sieves, of active carbon and so on; a drawback of these physical sorption agents, however, resides in a reversible sorption of the gases, as a function of temperature, and therefore they are not completely suitable for the purposes of the thermal insulation. Better results, to this purpose, are reached by employing materials which can irreversibly adsorb and fix the gases, according to a chemical reaction, like for instance the drying agents, in the case of water vapor, or the so-called getter materials, in the case of gases like CO, $CO_2$, $O_2$, $N_2$ and so on or, again, water vapor.

In the following, when not better specified, the drying agents and the getter materials will be generally indicated as chemical sorption agents or simply "sorption agents"; this chemical technique is well known from the state of the art, for instance from the international publication WO 93/25, 843 in the name of the Application and published on Dec. 23, 1993, after the priority date of the present application.

The document, cited as a reference with respect to the physico-chemical aspects of the sorption of gases and vapours, describes the combined use of a drying agent, selected from barium oxide, strontium oxide, phosphorus oxide and mixtures thereof, and of a non-evaporable getter material essentially consisting of an alloy containing barium and lithium, in particular an alloy having the raw formula $BaLi_4$; according to said document, it is optionally possible to introduce into the jacket also the oxide of a noble metal, preferably palladium, allowing to convert the last traces of hydrogen into water, which is then chemically fixed by the drying agent. As to the purpose, the use of silver and/or ruthenium oxide give rise to equally satisfactory results as the ones coming from the use of Pd oxide.

Said PCT document was teaching too to introduce the drying agent and the getter material into a housing subdivided into two separate zones by means of a porous septum; the drying agent is lying in the outer zone and the getter material in the inner zone, which is only indirectly in communication with the jacket empty space just because of the existence of said porous (gas permeable) septum and the said outer zone containing the drying agent.

The method described in said PCT application is already representing an improvement, with respect to the known technique, as to the physico-chemical aspects of a long lasting vacuum maintenance. Said method, however, does not eliminate a drawback which was normally present in the field of the sorption materials; these materials in fact, because of their peculiar prefixed task, have to be highly active with respect to the gases to be absorbed. On the other side, the reactivity of the drying agents and/or getter materials should be inhibited for a time of a few days or even months, when they are manufactured, as usual, by means of a process different from the manufacture of the end-use jackets.

This drawback can be in a few cases by-passed by using materials showing a low reactivity in the air, before the activating thermal treatment, to be performed only when the getter is already assembled in its final working position and when the jacket is already evacuated and sealed. The thermal treatment, however, generally requires temperatures of at least 200° C., not always compatible with the material of the jacket's walls, as in the case for instance of the panels made from plastic materials employed for the thermal insulation of refrigerators, freezers and tankers described for instance in U.S. Pat. Nos. 5,018,328 and 5,091,233; other solutions of the problem, providing no thermal activation, were proposed in other different patents.

U.S. Pat. No. 3,114,469, for instance, describes a vacuum jacket containing, fastened to the outer wall, a capsule made from a material which can undergo a distortion without loosing its gas-impermeability; said capsule contains a housing made from a material, for instance glass, which can be easily broken consequently to the distortion of the outer envelope, and the housing contains in its turn the getter material. Such a solution of the problem is theoretically effective but it is difficult (and expensive) to carry out a practical realization, on an industrial level, and anyhow the welding between said outer envelope and the outer wall of the vacuum jacket is representing the critical point of the structure, corresponding to a not neglectable danger of breakage.

U.S. Pat. No. 4,668,551 describes a thermal insulation unity in the form of an envelope made of plastics, containing an insulating material of the type hereinabove, some activated carbon and a gas impermeable bag containing a zeolite powder previously conditioned in an atmosphere of a gas which cannot be adsorbed by the zeolite, like hydrogen, helium, neon, alcohol vapours or vapor of hydrocarbons having at least 3 C atoms.

The zeolite containing bag is then opened during the sealing of the thermal insulation unit, occurring in an evacuated room. The method described in this patent is however showing a few drawbacks. First of all the employed zeolites are poorly effective as to the maintenance of the vacuum degree; furthermore it is required a peculiar process step for gas-conditioning the Zeolites and finally it is necessary to add to the thermal insulation unit, besides the zeolite containing bag, also an activated carbon, in order to adsorb the gases (generally organic gases) which are not adsorbed by the same zeolite.

At last, U.S. Pat. No. 5,191,980, granted to the Applicant, describes a getter housing sealed by a film of thermoretractable material; the getter material gets into contact with the inner space of the vacuum jacket when the jacket is already sealed, because of a heat treatment allowing the thermoretractable film to shrink and to get broken. Also in this use, however, the heat treatment required by the film opening may be incompatible with the jacket's walls, when made from plastics.

It is thus an object of the present invention to provide a method for the stabilization of the vacuum level inside an insulating vacuum jacket which do not suffer from the drawbacks of the known technique.

A second object of the present invention is to provide a combination of gas-sorbing materials which do not require any thermal activation during the manufacture of the relevant jackets.

A further object of the present invention is to provide a vacuum stabilizing device, or, shortly, vacuum stabilizer, containing said combination of sorption agents, preventing the deterioration of the same sorption agents, even for a period of months, allowing a rapid and simple activation of the same agents at the time of introduction of said sorption agents into the end-use vacuum jackets.

A still further object of the present invention is to provide a method for the manufacture of said vacuum stabilizer.

Disclosure

These and still further objects can be easily achieved by means of the present invention, residing in a vacuum stabilizer containing with a drying agent and a non-evaporable getter material and essentially consisting of:

a) a housing made from a gas-impermeable material, having the shape of a small box, opened at its uppermost end and having bent uppermost edges extended towards the exterior, as to form a peripheral wing;

b) a first septum, made from a gas-permeable material allowing an easy flow of the gases, fastened to the uppermost part of the inner walls of the housing under item a), as to define a geometrical volume in contact with the exterior through the same septum;

c) a second septum allowing too an easy flow of the gases, fastened to the inner walls of the housing along a line note higher than the fastening line of said first septum, as to subdivide the geometrical volume under item b) into two sub-volumes, the one uppermost (sub-volume I) and the other lowermost (sub-volume II);

d) a drying agent, contained in sub-volume I;

e) a non-evaporable getter material, contained in sub-volume II;

f) a film made from a gas-impermeable material, gas-tight fastened to said wing under item a), along a fastening zone only completely arranged in the outermost part of said wing, as to completely cover said housing.

It is optionally possible to add to the drying agent, in sub-volume I, also a hydrogen converting agent, as described in the already mentioned publication WO 93/25, 843. An addition of an alumina powder may prevent the clogging of the drying agent, consequently to the sorption of moisture; particularly preferred is the use of alpha-$Al_2O_3$.

The sorption agents do not come into contact with the environment as long as the film under item f) is present; thus the stabilizing device can be stored, transported or handled even for months without any deterioration of the sorption agents contained therein. The device may be simply and rapidly activated, at the time of its introduction into the end-use vacuum jacket, by merely cutting the peripheral part of the wing, where the impermeable film is fastened. Such operation may be easily automated and performed under vacuum conditions during the last steps of a jacket's manufacture.

The housing under item a) may be made from a lot of different materials, provided they are gas-impermeable. As an example we may quote metals, plastics or combinations thereof. Particularly suitable, as to the easy mould-forming are a few metals like steel, nickel and aluminum; as an alternative, it is advantageous to use polymeric materials like polystyrene, polyethylene, polypropylene, nylon, polyvinylchloride, polyethylene-terephthalate and so on, optionally coated with a metal film in order to improve their gas-impermeability features; it may still further be suitably employed a metal material coated with a film of thermoweldable polymeric material, selected from the materials hereinabove, in order to speed up the fastening operations required by the manufacture of the device.

Said housing may show different shapes, for instance a rectangular, oval, elliptical, circular or lobed shape, the circular shape being most preferred; the cross-section of a circular housing may show for instance vertical walls, as in the case of a cylinder, or oblique walls thus defining a frustoconical space.

The gas-impermeable material used for realizing the cover, in order to temporarily isolate the sorption agents from the environment, may be just one of the materials employed for the manufacture of the housing. Even if it is not necessary to use the same material for the manufacture of the two parts, namely the housing and the cover, such a choice may preferable because it facilitates the adhesion or the thermowelding of said parts.

The gas-permeable septa allowing an easy flow of the gases described under items b) and c), each other equal or different, may be in their turn made from different materials, like for instance gauges or fabrics from polymeric materials like the ones employed for the manufacture of the housing, or metal webs or lattices. Said septa may be fastened to the inner walls of the housing under item a) in different ways, depending on the particular combination of materials employed for the manufacture of the housing and of the septa. In general, in any case, the most immediate and simple application techniques are the fastening by means of adhesion agents, the thermowelding and the mechanical sealing, achieved by folding onto a rigid part an anelastic material which can undergo a distortion.

The sorption agents according to the present invention can carry on their activity without any thermal activation, but a thermal activation at a temperature of about 1020–200° C. may lead to better results. A not neglectable advantage bound to the present invention, with respect to the known technique, is residing in that it is necessary neither to carry out the activation during the process for the manufacture of the vacuum jackets nor to carry out the same activation when a jacket is already sealed. In fact, according to the present invention, the sorption agents may be activated apart, during the process for the manufacture of the vacuum stabilizing device, even before their introduction into the same device, as to avoid either any deterioration of the optionally present polymeric materials or any pollution of the sorption agents from the side of said polymeric materials, Another advantage coming from the stabilizing device according to the invention resides in the easy automatic removal of the cover, allowing to make very simply ready the same device.

As to the particular physico-chemical features of the drying agents and of the non-evaporable getter materials respectively under items d) and e), reference is made to the cited publication WO 93/25,843; the present invention is an improvement thereof as far only as the peculiar realization aspects are concerned.

According to a second aspect of the present invention, a method for the manufacture of the new vacuum stabilizer may be essentially consisting of the following steps:

preparation of a housing, provided with a bottom and with sharable peripheral wing on its uppermost part, by moulding a gas-impermeable material;

definition of two different volumes by means of two essentially parallel septa, both made from a material allowing an easy gas flow therethrough, wherein the first uppermost volume I is comprised between said two septa and contains a drying agent, optionally in combination with a hydrogen converting material and/or alumina, and wherein the second lowermost volume II is comprised between said first volume I and said bottom of the housing and contains a non-evaporable getter material;

sealing by means of a gas-impermeable film to be fastened only to the outer most some of said peripheral wing.

The single steps of this method and in particular the definition of said volumes I and II may be carried out in different ways.

According to a preferred embodiment, after the moulding of gas-impermeable housing (e.g. by means of thermoforming, in the case of plastics) a metered amount of non-evaporable getter material is placed on the bottom of the housing.

A small gas-permeable bag, containing a dry agent and optionally also a hydrogen converter and/or alumina, is then prepared apart by placing such contents between said two septa, optionally welded in a partial way along their perimeter, which are then sealed along their whole perimeter, thus giving rise to said volume I.

Finally, said small beg is fastened to the uppermost part of the inner walls of said gas-impermeable housing, thus separating the already existing getter material from the outside, and the overall device is sealed, for storage purposes, by means of a gas-impermeable film fastened to said peripheral wing.

Following this preferred method, it is possible to maximize the simplification of the operative conditions because the gas-impermeable housing and the two gas-permeable septa (as well as, in certain cases, the gas-impermeable cover) may be assembled together by means of only one very smooth operation, for instance a heat-seeling.

As an alternative, a second method may be essentially consisting of the following sequential operative steps:

manufacture of the gas-impermeable housing provided with a peripheral wing and with a bottom as per the first method, and deposition of a non-evaporable getter material into the bottom of the same housing;

fastening to the inner walls of said housing one of the two required gas-permeable septa, thus defining the volume II hereinabove;

adding a drying agent and optionally also a hydrogen converting material and/or alumina and fastening to the inner walls and said housing another gas-permeable septum, thus defining the volume I hereinabove;

sealing the overall device by means of a gas-impermeable film, preferably fastened to the peripheral wing and said housing.

Other possible embodiments of the present invention will be clear to the skilled in the art, objects and advantages of the present invention will be more clear from the following detailed but not limiting description of a single illustrative example, by reference to the drawings, wherein:

FIG. 1 is a cross-section of the vacuum stabilizer according to the invention, enveloped by the protective gas-impermeable film;

FIG. 1*a* is an enlarged detail of FIG. 1, namely a cross-section of the peripheral wing and of the uppermost edge of the housing, where the fastening of the septa is realized, as well as the cover welding;

FIG. 2 is a simplified layout of the cover removal by means of a shearing tool;

FIG. 3 is the prospective cross-section of an alternative vacuum stabilizer after the cover removal;

FIG. 4 is a vacuum jacket containing an insulating material and also a vacuum stabilizer according to the present invention.

Figures 1, 1A:
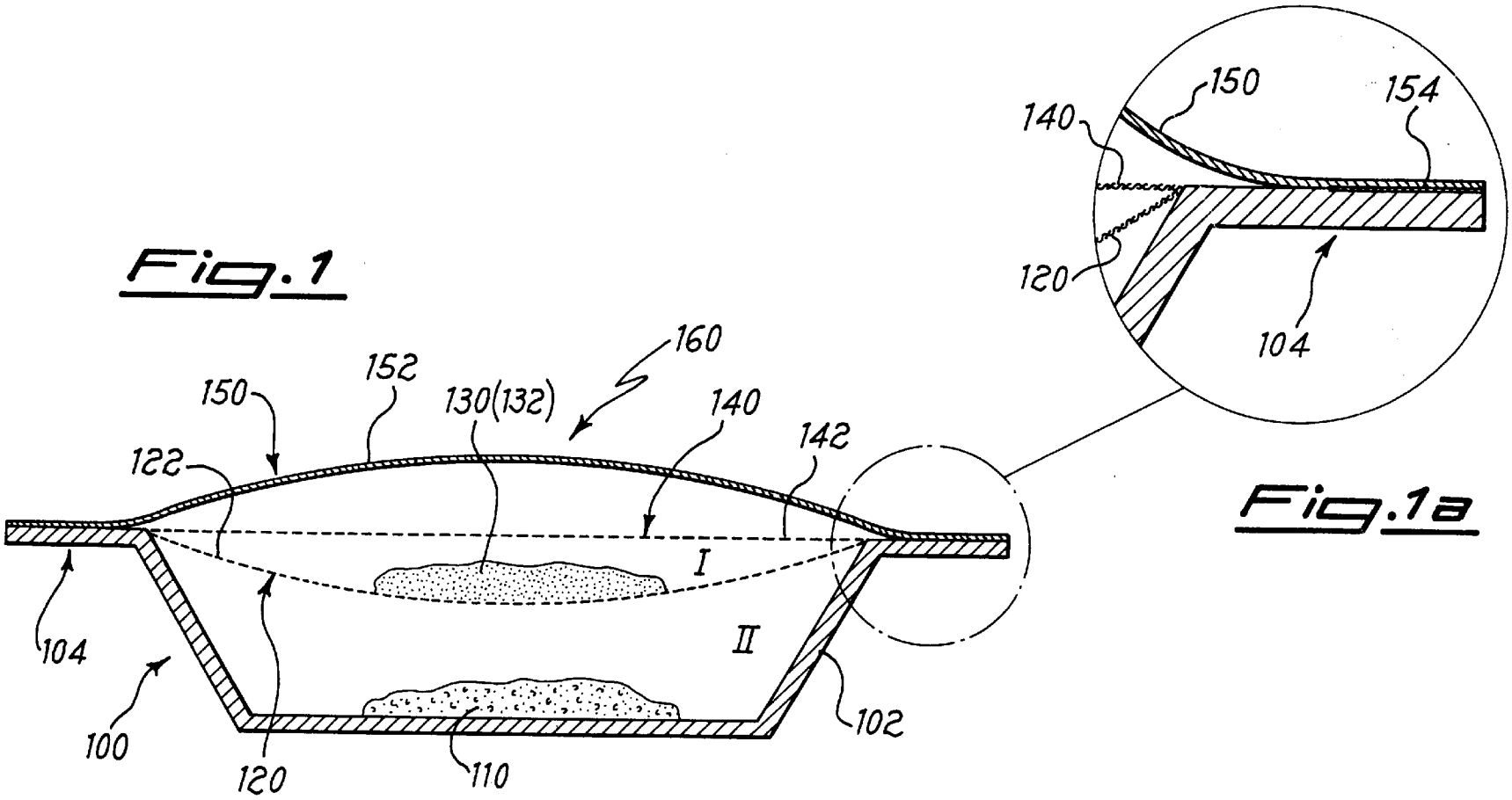

The vacuum stabilizer recorded on FIG. 1 is constituted by a housing 100, bound to ledge the sorption agents, made from a gas-impermeable material 102, wherein its uppermost edge is folded and extended towards the exterior as to define a peripheral wing 104. On the bottom of the housing 100, inside the volume II, there is a non-evaporable getter material which, as per the cited publication WO 93/25,843, is an alloy having the raw formula $BaLi_4$; such alloy is conveniently in the form of a powder, in order to supply a higher surface area for gas sorption purposes.

Said volume II is sealed, at its uppermost end, by a septum 120, made from a material 122, like gauge or polymeric webs, allowing an easy gas flow therethrough. In the uppermost part of the inner walls of the housing 100, along the same fastening line of septum 120, there is a fastened septum 140, made too from a material 142 allowing an easy gas flow therethrough, which is suitably equals the material 122 hereinabove. The two septa 120 and 140 are defining a volume I containing a drying agent 130, optionally in combination with a hydrogen converting material 132, both, preferably, in the form of a fine powder.

It is also possible to add alumina to the drying agent, in the form of a powder and preferably alpha-$Al_2O_3$.

The thus obtained preliminary device, containing the non-evaporable getter material as well as the drying agent, optionally in combination with hydrogen converter and/or alumina, is then sealed by means of a foil 150 made from a gas-impermeable material 152, fastened to the housing 100 in the outermost portion of the peripheral wing 104, along the fastening line 154 (see FIG. 1/*a*) thus obtaining a sealed device 160 which can be stored and/or transported even for a long period of time, without any deterioration of the sorption materials contained therein from the side of the environment.

The vacuum stabilizing device (VSD) according to the invention can be made ready by shearing the outer edge 154 of the wing 104 and of the foil 150, along a closed line which is an inner line with respect to the fastening zone 154 but an outer line with respect to the fastening zone of the septa 120 and 140.

Such operation may be made rapid and simple by providing a suitably designed shearing tool 170 as per FIG. 2.

FIG. 3 is the prospective vertical section of an alternative vacuum stabilizer after the cover removal simplified in FIG. 2, namely a stabilizer ready for the activation in a vacuum jacket.

Differently from the device recorded on FIG. 1, it is here shown an embodiment where the two septa 120 and 140 do not give rise to any bag to be prepared and filled apart; they have to be separately fastened to the inner walls of the housing (100) instead of being fastened by means of only one operation step. After the fastening of the lowermost septum 120, the materials 130 and optionally also 132, with or without $Al_2O_3$ powder, are introduced before the fastening of the uppermost septum 140.

FIG. 4 is the layout of a vacuum jacket containing a vacuum stabilizer 160 according to the present invention as well as an insulating filling material 180.

We claim:

1. A vacuum stabilizing device, containing both a drying agent (130) and a non-evaporable getter material (110), comprising of:

a) a housing (100) made from a gas-impermeable material (102), having the shape of a box opened on its uppermost part and having its uppermost edges folded and extended towards the exterior as to form a peripheral wing (104);

b) a first septum (140) made from a material (142) allowing an easy gas flow therethrough, fastened to the uppermost part of the inner walls of the housing (100) as to define a lower geometrical volume in contact with the outside just by means of said septum (140);

c) a second septum (120), made too from a material allowing an easy gas flow therethrough, fastened to the inner walls of said housing along a fastening line not higher than the fastening line of said first septum (140), as to divide said geometrical volume into an uppermost volume I and a lowermost volume II;

d) a drying agent (130) contained in said uppermost volume (I);

e) a non-evaporable getter material (110) contained in said lowermost volume II;

f) a film (150) made from a gas-impermeable material (152), gas-tight fastened to said wing (104) only along a fastening zone (154) lying completely in the outermost zone of said wing, as to completely shield the contents of said housing.

2. The device of claim 1, wherein said drying agent (130) is in combination with a hydrogen converter (132), selected from the oxides of silver, osmium, iridium, ruthenium, rhodium, palladium and combinations thereof.

3. The device of claim 2, wherein said hydrogen (132) converter is Pd oxide.

4. The device of claim 1, wherein said housing (100) is made from a material (102) selected from metals and plastics.

5. The device of claim 4, wherein said material (102) is a metal selected from steel, nickel and aluminium.

6. The device of claim 5, wherein said material (102) is coated, on its inner surface, by a polymeric material.

7. The device of claim 4, wherein said material (102) is a plastic material coated by a thin metal layer.

8. The device of claim 1, wherein said septa (120) and (140) are respectively made from materials (122) and (142) allowing an easy gas flow therethrough, selected from gauges and fabrics, made from polymeric materials, and metal webs or lattices.

9. The device of claim 1, wherein said drying agent (130) is selected from the oxides of barium, strontium, phosphorus and combinations thereof.

10. The device of claim 9, wherein said drying agent is in combination with alumina.

11. The device of claim 1, wherein said non-evaporable getter material (110) is an alloy containing barium and lithium.

12. The device of claim 11, wherein said alloy has the row formula $BaLi_4$.

13. The device of claim 1, wherein said film (150) is made from a gas-impermeable material (152) selected from metals and plastics coated by a thin metal layer.

14. A vacuum jacket containing the vacuum stabilizing device according claim 1.

15. A method for the manufacture of the vacuum stabilizing device according to claim 1, comprising of the following steps:

preparing a housing having a bottom part, an uppermost part and a shearable peripheral wing on the uppermost part, the housing prepared by molding a gas-impermeable material;

defining two different volumes including an uppermost volume I and a lowermost volume II, the volumes defined by two generally parallel septa, both septa being made from a material allowing an easy gas flow therethrough, wherein the first uppermost volume I is located between said two septa and the second lowermost volume II is located between said first volume I and the bottom of the housing, and wherein the first uppermost volume I contains a drying agent, wherein the drying agent is a material selected from the group including a drying agent, a combination of drying agent with hydrogen converting material, a combination of drying agent with alumina, and a combination of drying agent with hydrogen converting material and alumina and the second lowermost volume II contains a non-evaporable getter material; and sealing said housing with a gas-impermeable film fastened to said peripheral wing.

16. The method of claim 15, wherein said first volume (I) is realized by:

a) preparing a bag by placing the drying agent between said two septa, said two septa being secured in a partial way along their border, which septa are then completely sealed all along their perimeter; and b) fastening said bag to the uppermost part of the inner walls of said housing.

17. The method of claim 15, wherein:

i) said non-evaporable getter material is placed onto said bottom of said housing;

ii) said lowermost volume II is defined by fastening to the inner walls of said housing one of said two septa;

iii) said drying agent is added;

iv) said uppermost volume I is defined by fastening to said inner walls of said housing the other septum along a fastening line, which is not higher than the fastening line of the former septum, before the conclusive sealing of the overall device by means of said gas-impermeable film.

* * * * *